US006034041A

United States Patent [19]

Nittel et al.

[11] Patent Number: 6,034,041

[45] Date of Patent: Mar. 7, 2000

[54] LUBRICANT FOR METAL FORMING

[75] Inventors: Klaus-Dieter Nittel, Frankfurt am Main; Norbert Schwinke-Kruse, Dreieich; Günter Hesse, Hassloch, all of Germany

[73] Assignee: Metallgesellschaft Aktiengesellschaft, Frankfurt am Main, Germany

[21] Appl. No.: 09/137,804

[22] Filed: Aug. 20, 1998

[51] Int. Cl.[7] ..... C10M 157/00; C10M 173/02

[52] U.S. Cl. ..... 508/474; 508/469; 508/472; 508/473; 508/507; 508/591; 72/42

[58] Field of Search ..... 500/474

[56] References Cited

U.S. PATENT DOCUMENTS

| | | | |
|---|---|---|---|
| 3,287,264 | 11/1966 | Topper | 252/28 |
| 3,478,554 | 11/1969 | Demsey | 72/42 |
| 3,725,274 | 4/1973 | Orozco | 508/158 |
| 3,992,303 | 11/1976 | Barker et al. | 508/172 |
| 3,995,465 | 12/1976 | Felton, Jr. | 72/42 |
| 4,043,925 | 8/1977 | Felton, Jr. | 508/173 |
| 4,052,323 | 10/1977 | Feneberger et al. | 72/42 |
| 4,111,820 | 9/1978 | Conti | 72/42 |
| 4,256,591 | 3/1981 | Yamamoto et al. | 252/49.3 |
| 4,465,883 | 8/1984 | Lopata et al. | 508/591 |
| 4,466,909 | 8/1984 | Stayner | 252/49.5 |
| 4,474,669 | 10/1984 | Lewis et al. | 252/49.3 |
| 4,654,155 | 3/1987 | Kipp et al. | 508/431 |
| 4,752,405 | 6/1988 | Kyle | 508/404 |
| 4,950,415 | 8/1990 | Malito | 72/42 |
| 5,141,659 | 8/1992 | Kashiwaya et al. | 508/591 |
| 5,368,757 | 11/1994 | King | 508/232 |
| 5,624,888 | 4/1997 | Przybylski et al. | 508/161 |

FOREIGN PATENT DOCUMENTS

| | | |
|---|---|---|
| 0175547 | 3/1986 | European Pat. Off. . |
| 0251192 | 6/1987 | European Pat. Off. . |
| 0317684 | 5/1989 | European Pat. Off. . |
| 0363824 | 4/1990 | European Pat. Off. . |
| 0043182 | 1/1992 | European Pat. Off. . |
| 3720841 | 1/1988 | Germany . |
| 4129494 | 3/1993 | Germany . |
| 9207924 | 5/1992 | WIPO . |

*Primary Examiner*—Ellen M. McAvoy
*Attorney, Agent, or Firm*—Filbright & Jaworski, LLP

[57] ABSTRACT

Disclosed is a solid or aqueous lubricant concentrate used for the cold forming of metals, which, with reference to the solids content, including a) 20 to 50 parts by weight polyethylene with a softening point above 120° C. and a particle size int he range between 0.1 and 50 $\mu$m; b) 20 to 8 parts by weight polyacrylate with a molecular weight of 4,500 to 10,000 and c) 2 to 8 parts by weight styrene/acrylic acid copolymer with a molecular weight of 150,000 to 250,000 and a glass transition temperature of 45 to 55° C., where, under the conditions of use, the acrylic acid component of the polymers in accordance with items b) and c) is predominantly present as salt of one or more inorganic cations, and the softening points of the individuals polymers are distributed over the temperature range defined by the limiting values of ambient temperature and 200° C. The lubricant concentrate may contain homo-or copolymers or acrylic acid or the esters thereof with graded molecular weights as well as surfacant. Also disclosed is a method for facilitating the cold forming, where, by means of the lubricant concentrate, a lubricant film is applied on the workpiece from a dispersion having solids content of 5 to 25 wt-%.

13 Claims, No Drawings

LUBRICANT FOR METAL FORMING

BACKGROUND OF THE INVENTION

The invention relates to a lubricant concentrate for the cold forming of metals, the concentrate having a content of polyethylene, polyacrylate and styrene/acrylic acid copolylmer, and to a method for facilitating the cold forming of metallic workpieces.

In the cold forming of metallic workpieces it is common practice to provide the workpiece with a coating of a lubricant in order to reduce the frictional resistance between the surface of the workpiece and the forming tool. Substantially two procedures are commonly used for the preparation of a workpiece for a cold forming operation. In accordance with one procedure, lubricant including high-pressure additives or viscosity regulators is used when lower forming degrees are required. The other procedure consists in first applying a resin-based lubricant film from an organic phase and then applying a lubricating oil. This procedure is normally used when severe forming operations are to be performed.

Recently, the use of lubricants for various purposes has been constantly increasing. Under severe forming conditions the aforementioned lubricant systems no longer provide satisfactory performance. Certain problems regarding environmental protection and workplace hygiene result from the frequently existing content of organic solvents. Aspects of inflammability also play an often significant role.

What is of further considerable importance in the use of lubricants is whether the lubricant film left on the workpiece after the forming operation can easily be removed, for instance, by means of an aqueous cleaning agent.

From among the resin-containing lubricants, those based on an acrylate resin are particularly important. From the EP-A-0 175 547 it is known, for instance, to use lubricants for the cold forming of metal tubes which include a dispersion of a butyl acrylate/methyl methacrylate-ester copolymer that is defined therein in greater detail.

Another lubricant for the cold forming of metals contains 10 to 35 wt-% of an acrylate-based thermosetting resin with a glass transition temperature of −10 to +25° C., 3 to 15 wt-% wax and 0.5 to 5 wt-% surfactant. The weight ratio between thermosetting resin and wax should be adjusted to 2:12. The thermosetting resin represents a copolymer of different monomers with a degree of polymerization of 1000 to 50000 (DE-A-37 20 841).

Also, a concentrate for preparing a formulation suited for applying a lubricant coating, which contains a film-forming component, an olefin and a flow-control agent is known. The ratio between film-forming component and polyolefin should be in the range of from 0.25:1 to 2:1. Acrylate-based polymers and copolymers are mentioned as film-forming components. As flow-control agents, dihydric and trihydric alcohols, glycol ethers, butyl Cellolsolves, surfactants or phosphate ethers and esters can be used (WO 92/07924).

The aforementioned lubricants and lubricant concentrates have in common that they cannot satisfy the requirements put forward in practice, in particular the requirements as regards lubricity, environmental protection, work-place hygiene and removability after the forming operation.

It is the object of the invention to provide a lubricant concentrate for the formulation of a lubricant for the cold forming of metals, which also allows severe forming operations to be performed satisfactorily, is substantially aqueous and thus unobjectionable as regards environmental protection and work-place hygiene, and can easily be removed after the forming operation.

THE INVENTION

The above stated object is obtained in that the lubricant concentrate of the above-mentioned type is formulated in accordance with the present invention in such a way that, with reference to the solid content, it contains:

a) 20 to 50 parts by weight polyethylene with a softening point above 120° C. and a particle size in the range between 0.1 and 50 $\mu$m;

b) 2 to 8 parts by weight polyacrylate with a molecular weight of 4500 to 10000; and c) 2 to 8 parts by weight styrene/acrylic acid copolymer with a molecular weight of 150,000 to 250,000 and a glass transition temperature of 45 to 55° C., where, under the conditions of use, the acrylic acid component of the polymers in accordance with items b) and c) is predominantly present as the salt of one or more inorganic cations, and the softening points of the individual polymers are distributed over the temperature range defined by the limiting values of ambient temperature and 200° C.

The lubricant concentrate in accordance with the invention can both be present in solid form and in the form of a liquid concentrate.

When the lubricant concentrate is present in aqueous form, the acrylic acid component corresponding to polymers b) and c) will already be predominantly present as salt of inorganic cations. If the lubricant concentrate is solid, however, the acrylic acid component will generally be present as free acid, and the concentrate will include the required amount of inorganic cations, for instance, in the form of their hydroxides.

It is important that the lubricant concentrate in accordance with the invention and the lubricant applied onto the workpiece by means of the lubricant concentrate have softening points of the individual components distributed over the temperature range which is usually covered during the forming of the workpiece. This temperature range is defined by the limiting values of ambient temperature and 200° C. measured at the workpiece surface. Due to the distribution of the softening points of the individual polymers over that temperature range, the lubricant film plasticizes step by step and can follow the occurring increase of the surface without film rupture.

In a preferred embodiment of the invention, the lubricant concentrate has an additional content of 2 to 8 parts by weight polyacrylate with a molecular weight of 3000 to 4500. Even in this embodiment, the acrylic acid component under the conditions of use should predominantly be present as salt of inorganic cations, and the softening point of the component should lie within the aforementioned temperature range.

It is particularly advantageous for the acrylic acid component of the lubricant concentrate to be present as salt of the cations ammonium, sodium, potassium, lithium, calcium, zinc, bismuth and/or barium.

In another advantageous embodiment of the invention, the lubricant concentrate includes an additional content of 2 to 8 parts by weight of a copolymer of acrylic acid ester of ethanol and/or propanol and methacrylic acid with a molecular weight of at least 300,000. In this case as well, under the conditions of use, the methacrylic acid component should predominantly be present as salt of inorganic cations, where the salt-forming cation originates from the group including ammonium, sodium, potassium, lithium, calcium, zinc, bismuth and/or barium. The monomer ratio of acrylic acid ester:methacrylic acid lies in the range of from 3:1 to 1:1.

In a further preferred embodiment of the lubricant concentrate of the invention, the concentrate contains an additional content of 5 to 15 parts by weight of a nonionic surfactant, preferably an ethoxylated fatty alcohol having more than 6 ethylene oxide groups, and/or a further content of 12 to 25 parts by weight of ethylene/acrylic acid copolymer with a molecular weight of 6,000 to 10,000 and a monomer ratio of ethylene:acrylic acid of from 9:1 to 2:1.

Finally, an advantageous embodiment of the lubricant concentrate consists in having an additional content of 2 to 8 parts by weight of sulfosuccinic acid diester.

The subject-matter of the invention also is in a method for facilitating the cold forming of a metallic workpiece by means of the above-described lubricant concentrate, where the lubricant facilitating the cold forming is applied to the workpiece surface from an aqueous dispersion containing 5 to 25 wt-% solid matter. Expediently, the application from the dispersion should be effected such that after drying a coating weight of 0.05 to 10 g/m$^2$ is obtained.

Usually, the lubricant film applied onto the workpiece by means of the invention sufficiently satisfies the existing requirements, even if cold forming processes are carried out in several stages.

In accordance with a further advantageous embodiment, the invention provides for, in the case of particularly severe forming operations, forming a conversion coating, in particular a phosphate coating, on the workpiece surface prior to the application of the lubricant.

The lubricant concentrate in accordance with the invention can contain the pigments known per se, such as graphite, molybdenum disulfide, titanium phosphate and/or borate. In addition, effective inhibitors can be added for individual workpieces, depending on the respective application.

By means of the lubricant concentrate in accordance with the invention, lubricants for facilitating the cold forming can be applied on workpieces made of iron, steel, aluminum, zinc, copper and the alloys thereof.

The invention will be illustrated in greater detail by way of the following examples.

EXAMPLE 1

For preparing an aqueous concentrate the following was added under vigorous stirring to 62 parts by weight of de-ionized water:

- 19 parts by weight polyethylene with a particle size of 2 to 20 $\mu$m and a softening point of 140° C.;
- 2.5 parts by weight polyacrylate with a molecular weight of 8,000;
- 2.5 parts by weight styrene/acrylic acid copolymer with a molecular weight of 200,000;
- 2.5 parts by weight polyacrylate with a molecular weight of 3,700;
- 3 parts by weight ethoxylated fatty alcohol with an average number of 8 ethylene oxide groups; as well as
- 8.5 parts by weight of a 35 wt-% solution of ethylene/acrylic acid copolymer with a molecular weight of 8,000.

There was obtained a stable dispersion having a solids content of 32.48 wt-%.

Also under stirring, 1 part by weight of this concentrate was homogeneously distributed in 4 parts by weight of de-ionized water, in order to obtain a specific lubricant bath for the immersion treatment.

Steel slugs having a diameter of 25 mm and a height of 25 mm, which had been phosphatized at room temperature, were dipped into the lubricant bath having a temperature of 20° C for the duration of 1 minute and were then dried. The lubricant coating thus obtained had a weight of 1.2 g/m$^2$.

Subsequently, the steel slugs thus pretreated were formed in a backward extrusion process. The extrusion forces applied were 666 kN, the ejection forces were 31 kN, and the forming degree was 62%. The evaluation of the steel cups obtained revealed that the entire surface had a continuous phosphate/lubricant coating, i.e., a contact between workpiece and tool—visible by scoring—had not occurred.

EXAMPLE 2

The concentrate obtained in accordance with Example 1 was diluted with fully deionized water in a weight ratio of 1:1 for coating bare stainless steel tubes. The application of the lubricant was effected by dipping for 3 minutes at room temperature and subsequent drying. The lubricant film had a weight of 4 g/m$^2$. Stainless steel tubes with numerous and various dimensions and forming degrees could easily be drawn without noting a scoring.

EXAMPLE 3

A lubricant concentrate was prepared by measuring the following under stirring into 74.5 parts by weight de-ionized water:

- 12 parts by weight polyethylene with a particle size of 2 to 20 $\mu$m and a softening point of 140° C.;
- 1.5 parts by weight polyacrylate with a molecular weight of 8,000;
- 1.5 parts by weight styrene/acrylic acid copolymer with a molecular weight of 200,000;
- 1.5 parts by weight polyacrylate with a molecular weight of 3,700;
- 1.5 parts by weight of a 25 % dispersion of ethyl acrylate/methacrylic acid with a molecular weight >300,000 and a monomer ratio of ethyl acrylate:methacrylic acid of 2:1;
- 2 parts by weight ethoxylated fat to alcohol with an average number of 8 ethylene groups; and
- 5.5 parts by weight of a 35 wt-% solution of ethylene/acrylic acid copolymer with a molecular weight of 8,000.

Wires of stainless steel grade X5CrNi18.10 having a diameter of 4.2 mm were dipped for 1 minute into a lubricant bath of room temperature and were subsequently dried. The lubricant bath had been prepared by diluting 70 parts by weight concentrate with 30 parts by weight de-ionized water.

Without another application of lubricant, a first batch of stainless steel wires were drawn in nine passes to 1.5 mm, which corresponds to a forming degree of 87.2%. A second batch was drawn in three passes to a final diameter of 1.82 mm corresponding to a forming degree of 81.2%. In both cases the results obtained were perfect.

EXAMPLE 4

An aqueous lubricant concentrate was prepared by adding the following under vigorous stirring to 70 parts by weight de-ionized water:

- 14.5 parts by weight polyethylene with a particle size of 2 to 20 $\mu$m and a softening point of 140° C.;
- 2.0 parts by weight polyacrylate with a molecular weight of 5,000;

2.0 parts by weight styrene/acrylic acid copolymer with a molecular weight of 200,000;

2.0 parts by weight polyacrylate with a molecular weight of 4,200;

2.0 parts by weight ethoxylated fatty alcohol with an average number of 8 ethylene oxide groups;

6.5 parts by weight of a 35 wt-% solution of ethylene/acrylic acid copolymer with a molecular weight of 6,000; as well as 1.0 part by weight sulfosuccinic acid diisooctyl ester.

A stable dispersion with a solids content of 25.8 wt-% was obtained.

In order to obtain a specific lubricant for roll coater coating, 1 part by weight of this concentrate was homogeneously distributed under stirring in 4 parts by weight fully de-ionized water.

Steel and aluminum strip, each bare and phosphated, was coated with the lubricant heated to 30° C., so that after drying a lubricant film of 0.6 g/m$^2$ was obtained.

Subsequently, the strips were cut into circles and on a multistage press were formed into deep-drawn pressings for the automotive industry without adding further lubricant. The deep-drawn pressings had a perfect quality. The pressings could subsequently be easily cleaned with an aqueous alkaline spray cleaner.

EXAMPLE 5

An aqueous lubricant concentrate was prepared by adding the following under vigorous stirring to 58 pars by weight de-ionized water:

16.5 parts by weight polyethylene with a particle size of 2 to 20 $\mu$m and a softening point of 140° C.;

2.0 parts by weight polyacrylate with a molecular weight of 7,700;

2.0 parts by weight styrene/acrylic acid copolymer with a molecular weight of 200,000;

2.0 parts by weight polyacrylate with a molecular weight of 4,200;

2.5 parts by weight ethoxylated fatty alcohol with an average number of 8 ethylene oxide groups;

7.0 parts by weight of a 35 wt-% solution of ethylene/acrylic acid copolymer with a molecular weight of 6,000; as well as 10 parts by weight graphite.

A stable dispersion with a solids content of 37.45 wt-% was obtained.

1 part by weight of this concentrate was homogeneously distributed under stirring in 3 parts by weight de-ionized water in order to obtain a lubricant bath for the immersion treatment.

Rod-shaped raw material for the manufacture of vehicle steering parts was dipped into the lubricant bath for 0.5 minutes at room temperature. After the subsequent drying the coating weight was 1.6 g/m$^2$. Forming was effected by rotary forging to obtain a part ready to be installed.

It will be understood that the specification and examples are illustrative but not limitative of the present invention and that other embodiments within the spirit and scope of the invention will suggest themselves to those skilled in the art.

What is claimed is:

1. A lubricant concentrate for the cold forming of a metal, comprising with reference to the solids content;

(a) 20 to 50 parts by weight polyethylene with a softening point above 120° C. and a particle size in the range of 0.1 to 50 $\mu$m;

(b) 2 to 8 parts by weight polyacrylate with a molecular weight of 4,500 to 10,000;

(c) 2 to 8 parts by weight styrene/acrylic acid copolymer with a molecular weight of 150,000 to 250,000 and a glass transition temperature of 45 to 55° C., where, under the conditions of use, the acrylic acid component of the polymers of (b) and (c) is present as a salt of at least one inorganic cation in an amount of at least 50%, and the softening points of the individual polymers range from ambient temperature to 200° C.

2. The lubricant concentrate of claim 1 further comprising 2 to 8 parts by weight polyacrylate with a molecular weight of 3,000 to 4,500, where, under the conditions of use, the acrylic acid is predominantly present as salt of one or more inorganic cations and the softening point of the components is within the temperature range of from ambient to 200° C.

3. The lubricant concentrate as of claim 1 wherein the acrylic acid component is present as a salt of one or more cations selected from the group consisting of ammonium, sodium, potassium, lithium, calcium, zinc, bismuth and barium.

4. The lubricant concentrate of claim 1 further comprising an additional content of 2 to 8 parts by weight of a copolymer of acrylic acid ester of at least one of ethanol and propanol and methacrylic acid with a molecular weight of at least 300,000, where, under the conditions of use, the methacrylic acid component is present as a salt of an inorganic cation in an amount of at least 50% and the monomer ratio of acrylic acid ester:methacrylic acid is from 3:1 to 1.

5. The lubricant concentrate of claim 1 further comprising 5 to 15 parts by weight of a nonionic surfactant.

6. The lubricant concentrate of claim 1 further comprising 12 to 25 parts by weight ethylene/acrylic acid copolymer with a molecular weight of 6,000 to 10,000 and a monomer ratio of ethylene:acrylic acid in the range of from 9:1 to 2:1.

7. The lubricant concentrate of claim 1 further comprising 2 to 8 parts by weight sulfosuccinic acid diester.

8. A method for facilitating a cold forming of a metallic workpiece comprising: forming on the workpiece a lubricant film from an aqueous dispersion having a solids content of 5 to 25 wt-% of a lubricant concentrate of claim 1.

9. The method of claim 8, wherein the lubricant film is dried and has a dry weight of 0.05 to 10 g/m$^2$.

10. The method of claim 8 wherein a conversion coating is produced on the workpiece before application of the lubricant film.

11. The method of claim 10 wherein the conversion coating is a phosphate coating.

12. The lubricant concentrate of claim 4, wherein said cation is selected from the group consisting of ammonium, sodium, potassium, lithium, calcium, zinc, bismuth and barium.

13. The lubricant concentrate of claim 5, wherein said nonionic surfactant is an ethoxylated fatty alcohol having more than 6 ethylene oxide groups.

* * * * *

UNITED STATES PATENT AND TRADEMARK OFFICE

CERTIFICATE OF CORRECTION

PATENT NO. : 6,034,041
DATED : March 7, 2000
INVENTOR(S) : Nittel, et. al.

It is certified that error appears in the above-indentified patent and that said Letters Patent is hereby corrected as shown below:

Title page, item [57], Abstract, line 5, change "20" to --2--.

Signed and Sealed this

Twentieth Day of March, 2001

*Attest:*

*Attesting Officer*

NICHOLAS P. GODICI

*Acting Director of the United States Patent and Trademark Office*